US008336154B2

(12) United States Patent
Lin

(10) Patent No.: US 8,336,154 B2
(45) Date of Patent: Dec. 25, 2012

(54) MOP

(75) Inventor: Ching-Chun Lin, Yilan County (TW)

(73) Assignee: Ching-Chun Lin, Yilan County (TW)

( * ) Notice: Subject to any disclaimer, the term of this patent is extended or adjusted under 35 U.S.C. 154(b) by 315 days.

(21) Appl. No.: 12/761,266

(22) Filed: Apr. 15, 2010

(65) Prior Publication Data

US 2011/0083291 A1 Apr. 14, 2011

(30) Foreign Application Priority Data

Oct. 13, 2009 (TW) ..... 98218839 U

(51) Int. Cl.
*A47L 13/00* (2006.01)

(52) U.S. Cl. ..... 15/120.2; 15/229.1; 15/229.6

(58) Field of Classification Search ..... 15/120.1, 15/120.2, 228, 229.1, 229.6
See application file for complete search history.

(56) References Cited

U.S. PATENT DOCUMENTS

| | | | | |
|---|---|---|---|---|
| 6,045,284 | A * | 4/2000 | Chiu | 401/289 |
| 6,701,578 | B1 * | 3/2004 | Lu | 16/429 |
| 2005/0235446 | A1 * | 10/2005 | Eggers | 15/220.1 |
| 2007/0067935 | A1 * | 3/2007 | Lin et al. | 15/229.6 |
| 2007/0163065 | A1 * | 7/2007 | Chang | 15/144.4 |
| 2007/0226929 | A1 * | 10/2007 | Kao | 15/120.1 |
| 2009/0307855 | A1 * | 12/2009 | Kao | 15/3 |
| 2010/0139023 | A1 * | 6/2010 | Chen | 15/228 |
| 2010/0162507 | A1 * | 7/2010 | Lee | 15/228 |

* cited by examiner

*Primary Examiner* — Brian Glessner
*Assistant Examiner* — Adriana Figueroa
(74) *Attorney, Agent, or Firm* — Apex Juris, pllc; Tracy M. Heims

(57) ABSTRACT

The mop has a handle, a holding assembly and a head assembly. The holding assembly is mounted on the handle and has a sleeve mounted rotatably around the handle. The head assembly is mounted pivotally on the handle and has fiber strips. A user can hold the sleeve when the mop is wrung by a dehydration device. The sleeve will not be driven by the fiber strips or the handle. Therefore, the mop is stably and safely held and the mop can be more efficient to use.

8 Claims, 5 Drawing Sheets

MOP

BACKGROUND OF THE INVENTION

1. Field of the Invention

The present invention relates to a mop, and more particularly to a mop that has a sleeve for users to hold stably.

2. Description of the Prior Arts

A mop has multiple fabric strips mounted on a handle for cleaning floors. To clean floors, the mop must first be soaked in a bucket of water. Some buckets include a wringer. The wringer has multiple holes and allows users to remove excess water from the mop manually. However, a movement of rotating the mop to squeeze water is laborious. Some buckets include a dehydration device. The dehydration device has a motor and allows users to remove excess water from the mop automatically and efficiently. However, the dehydration device rotates under a lot of power during an actuation time, which prevents users from holding the handle stably and safely.

To overcome the shortcomings, the present invention provides a mop to mitigate or obviate the aforementioned problems.

SUMMARY OF THE INVENTION

The main object of the present invention is to provide a mop.

The mop comprises a handle, a holding assembly and a head assembly. The holding assembly is mounted on the handle and has a sleeve mounted rotatably around the handle. The head assembly is mounted pivotally on the handle and has multiple fabric strips. A user can hold the sleeve when the mop is wrung by a dehydration device. The sleeve will not be driven by the fabric strips or the handle. Therefore, the mop is stably and safely held and the mop can be more efficient to use.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
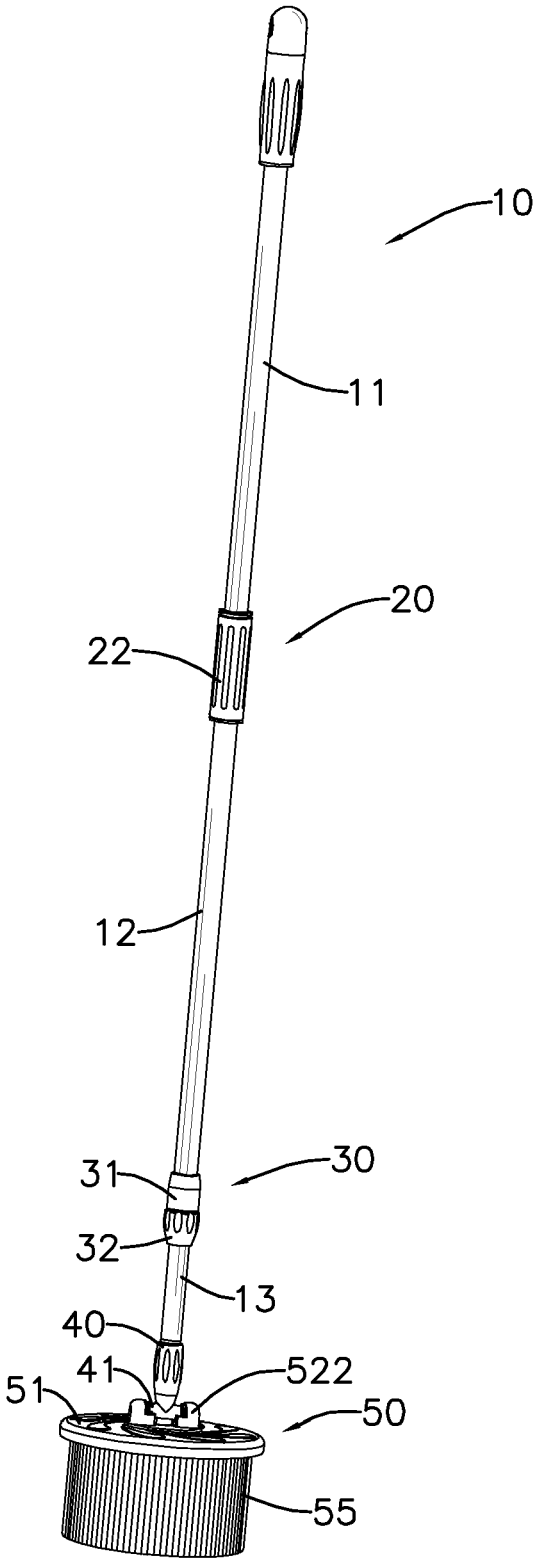
FIG. 1 is a perspective view of a mop in accordance with the present invention.
Figure 2:
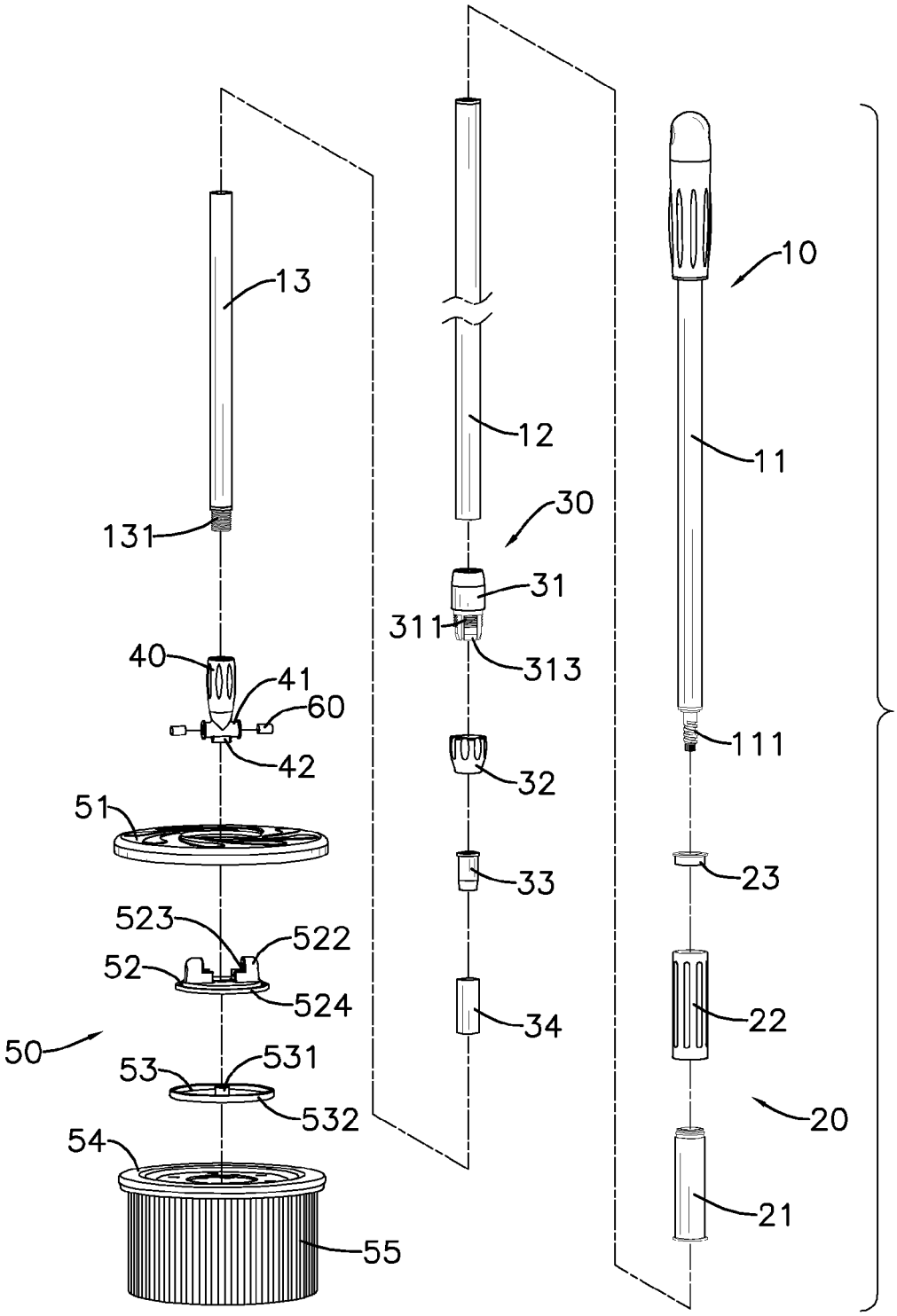
FIG. 2 is an exploded perspective view of the mop in FIG. 1.

With reference to FIGS. 1 and 2, a mop in accordance with the present invention comprises a handle (10), a holding assembly (20), a fixing assembly (30), an adapter (40) and a head assembly (50).

The handle (10) has a top tube (11), a bottom tube (12) and a slide tube (13). The top tube (11) has a bottom end. The bottom tube (12) has a top end and a bottom end. The top end of the bottom tube (12) is connected to the bottom end of the top tube (11). The slide tube (13) is mounted movably through the bottom tube (12) and has a top end, a bottom end and a top end surface.

Figure 3:
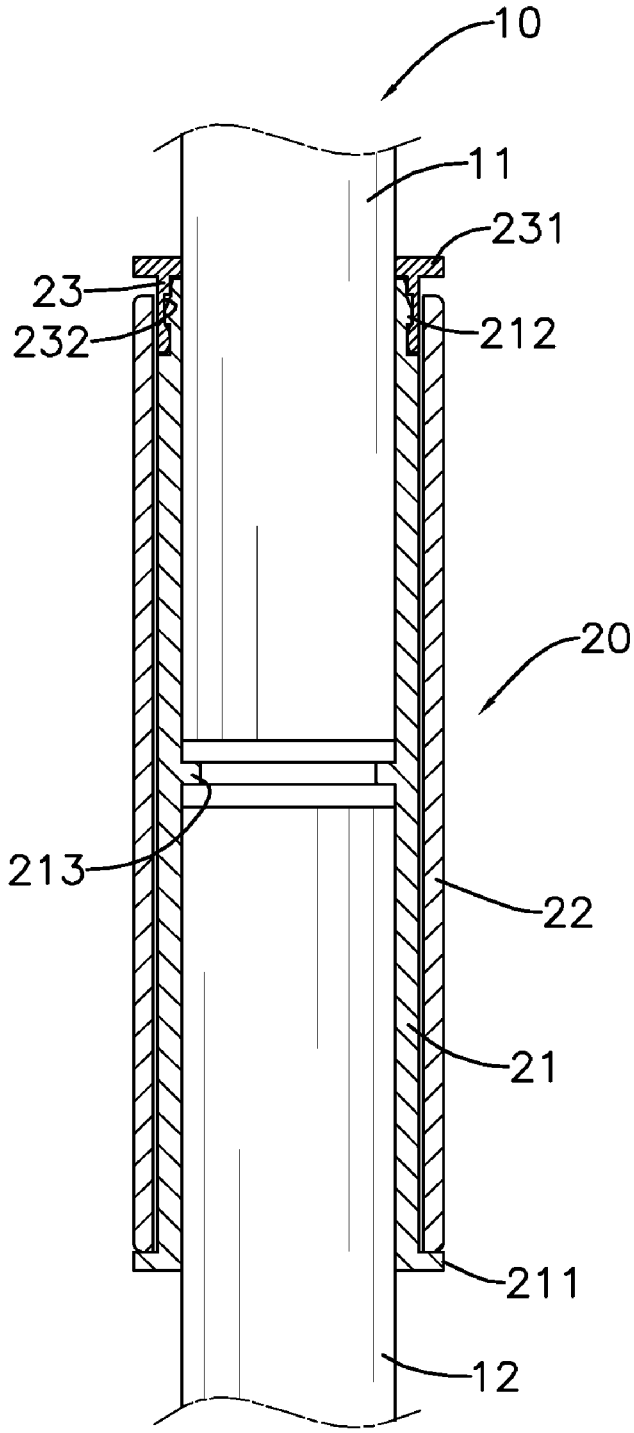
FIG. 3 is an enlarged front view in partial section of the holding assembly of the mop in FIG. 1.

With further reference to FIG. 3, the holding assembly (20) is mounted around the handle (10) and has a tubular connector (21), a sleeve (22) and a connecting ring (23). The tubular connector (21) is mounted around the top tube (11) and the bottom tube (12) to connect the top tube (11) and the bottom tube (12) securely, has an outside, an inside, a top end, a bottom end, a middle section, a flange (211), a convex part (212) and a positioning ring (213). The flange (211) is formed around and protrudes from the outside and the bottom end of the tubular connector (21). The convex part (212) is formed around and protrudes from the outside and the top end of the tubular connector (21). The positioning ring (213) is formed around and protrudes from the inside and the middle section of the tubular connector (21) and is clamped between the top tube (11) and the bottom tube (12).

The sleeve (22) is mounted rotatably around the tubular connector (21). The connecting ring (23) is connected to the top end of the tubular connector (21) and has an outside, an inside, a top end, a bottom end, a flange (231) and an annular groove (232). The flange (231) is formed around and protrudes from the outside and the top end of the connecting ring (23). The annular groove (232) is formed in the inside of the connecting ring (23) and engages the convex part (212) of the tubular connector (21). The sleeve (22) is limited between the flanges (211,231) of the tubular connector (21) and the connecting ring (23).

Figure 4:
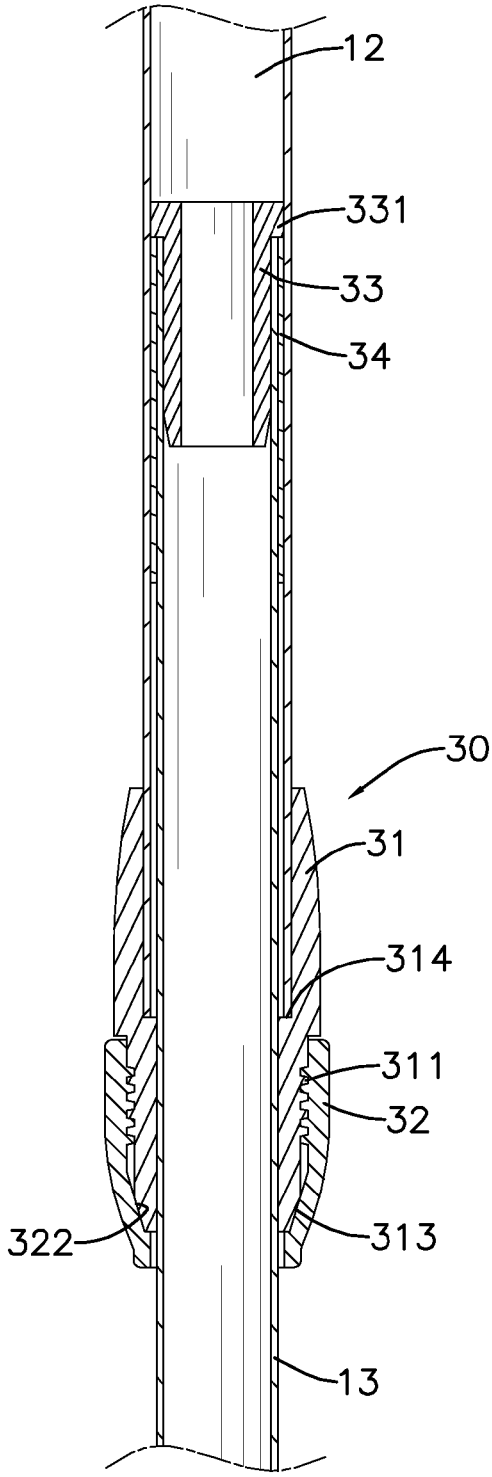
FIG. 4 is an enlarged front view in partial section of the fixing assembly of the mop in FIG. 1.

With further reference to FIG. 4, the fixing assembly (30) is mounted around the handle (10) and has a threaded tube (31), a nut (32), a liner tube (33) and a positioning sleeve (34). The threaded tube (31) is mounted around the bottom tube (12) and the slide tube (13) and connected securely to the bottom end of the bottom tube (12) and has an outside, an inside, a lower section, a thread part (311), a pressing surface (313) and an abutting surface (314). The thread part (311) is formed around the outside and the lower section of the threaded tube (31). The pressing surface (313) is formed on the lower section of the threaded tube (31). The abutting surface (314) is formed around the inside of the threaded tube (31).

The nut (32) is mounted around the slide tube (13) and is screwed onto the thread part (311) and has an inside, a lower section and a pushing surface (322). The pushing surface (322) is formed on the inside and lower section of the nut (32) and abuts the pressing surface (313) of the threaded tube (31). The liner tube (33) is mounted securely through the top end of the slide tube (13) and has an outside, a top end and an abutting ring (331). The abutting ring (331) is formed around and protrudes from the outside and the top end of the liner tube (33) and abuts the top end surface of the slide tube (13). The positioning sleeve (34) is mounted around the top end of the slide tube (13) and has a bottom end surface.

The nut (32) is rotated to be distant from the threaded tube (31) and the slide tube (13) can be moved along the bottom tube (12) up and down to adjust an appropriate position for different users or different use conditions. When the slide tube (13) is moved to a suitable height, screwing the nut (32) onto the threaded tube (31) causes the pushing surface (322) of the nut (32) to push the pressing surface (313) of the threaded tube (31) inward to abut the slide tube (13) and fix the bottom tube (12) and the slide tube (13). Besides, the bottom end surface of the positioning sleeve (34) can abut the abutting surface (314) of the threaded tube (31) to avoid detachment of the slide tube (13) from the bottom tube (12).

The adapter (40) is connected securely to the bottom end of the slide tube (13) and has a bottom end, a bottom end surface, a protrusion (42) and a positioning tube (41). The protrusion (42) protrudes from the bottom end surface of the adapter (40). The positioning tube (41) is mounted radially on the bottom end of the adapter (40).

Figure 5:
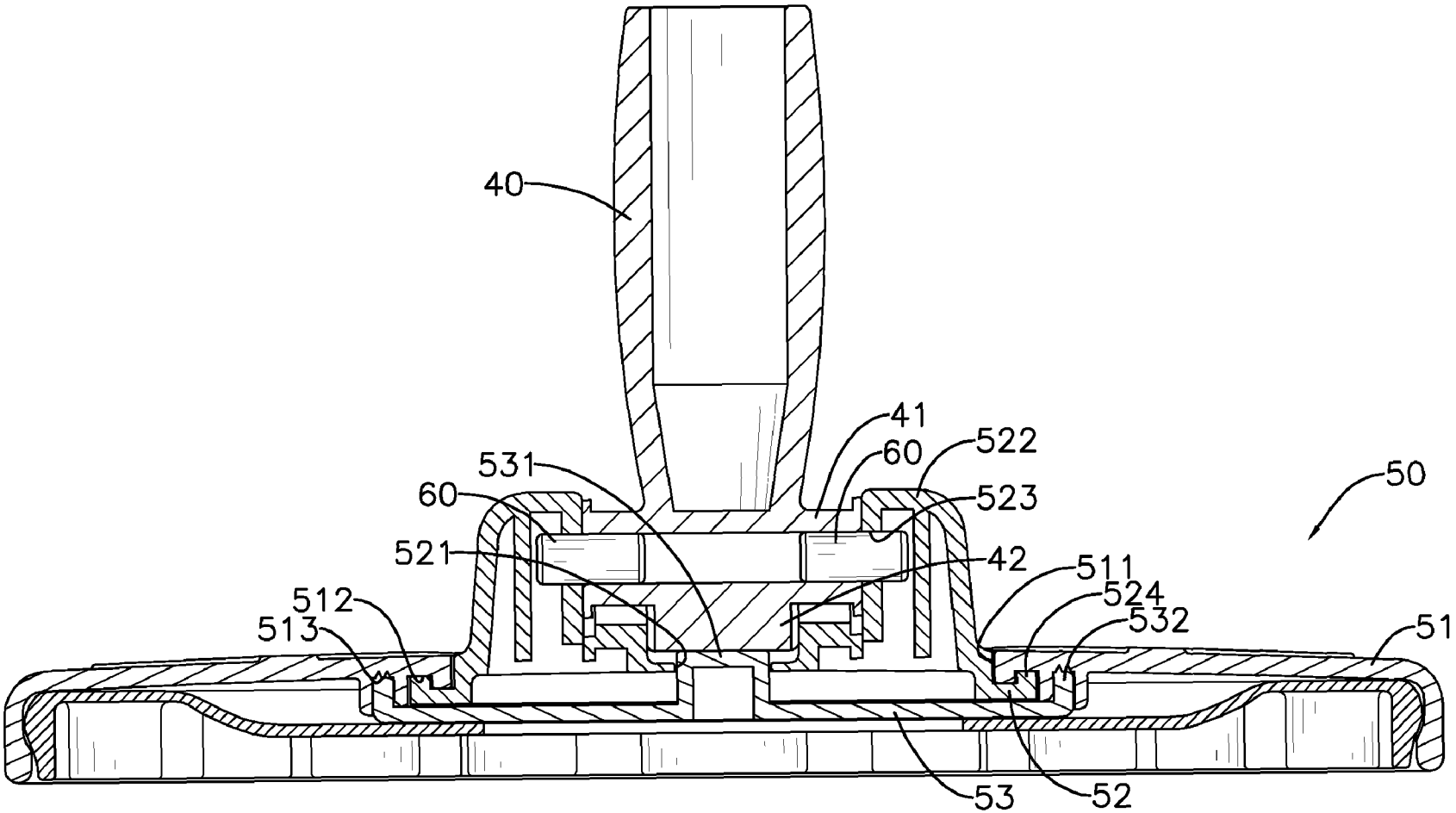
FIG. 5 is an enlarged front view in partial section of the head assembly of the mop in FIG. 1.

With further reference to FIG. 5, the head assembly (50) is mounted pivotally on the handle (10) and has a cover board (51), a joint seat (52), a rotating disk (53), a mounting board (54) and multiple fiber strips (55). The cover board (51) is circular and has a center, a bottom surface, a mounting hole (511), an inner annular recess (512) and an outer annual recess (513). The mounting hole (511) is formed through the center of the cover board (51). The inner annular recess (512) and the outer annual recess (513) are respectively formed in the bottom surface of the cover board (51). The inner annular recess (512), the outer annual recess (513) and the cover board (51) are concentric.

The joint seat (52) is circular and has a center, a top surface, a positioning hole (521), two connecting blocks (522) and an annular sidewall (524). The positioning hole (521) is formed through the center of the joint seat (52). The connecting blocks (522) protrude separately and symmetrically from the top surface of the joint seat (52) and are respectively positioned in two corresponding sides of the positioning hole (521). Each connecting block (522) has a pivot hole (523) formed radially in the connecting block (522) and the pivot holes (523) of the two connecting blocks (522) align with each other.

The rotating disk (53) is circular and has a center, a top surface, a column (531) and an annular sidewall (532). The column (531) protrudes from the center and the top surface of the rotating disk (53). The mounting board (54) is circular and is connected securely to the bottom surface of the cover board (51) and has a bottom surface. The fiber strips (55) are connected to the bottom surface of the mounting board (54).

The joint seat (52), the rotating disk (53) and the mounting board (54) are mounted sequentially on the bottom surface of the cover board (51). The connecting blocks (522) of the joint seat (52) protrude from the mounting hole (511) of the cover board (51). The annular sidewall (524) of the joint seat (52) is mounted in the inner annular recess (512) of the cover board (51). The column (531) of the rotating disk (53) protrudes from the positioning hole (521) of the joint seat (52). The annular sidewall (532) of the rotating disk (53) is mounted in the outer annual recess (513) of the cover board (51). The pivot holes (523) of the joint seat (52) of the head assembly (50) align with the positioning tube (41) of the adapter (40). Two pins (60) are mounted respectively through the pivot holes (523) and positioning tube (41) to connect the handle (10) and the head assembly (50) pivotally.

When the mop in accordance with the present invention is wrung by a dehydration device, users can hold the sleeve (22) of the holding assembly (20). Because the sleeve (22) is not driven by the fiber strips (55) or the handle (10), the mop can be wrung stably. Besides, when the handle (10) is in a vertical state, the protrusion (42) of the adapter (40) abuts the column (531) of the rotating disk (53) to allow the mop to be used stably and safely.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A mop comprising:

a handle;

a holding assembly mounted on the handle and having a tubular connector mounted around the handle and having an outside and a flange protruding from the outside of the tubular connector;

a sleeve mounted rotatably around the tubular connector; and a connecting ring connected to the tubular connector and having an outside and a flange protruding from the outside of the connecting ring, wherein the sleeve is limited between the flanges of the tubular connector and the connecting ring;

an adapter connected securely to the handle and having a bottom end surface and a protrusion protruding from the bottom end surface of the adapter; and a head assembly mounted pivotally on the handle and having a cover board having a center;

a bottom surface;

a mounting hole formed through the center of the cover board; and an inner annular recess and an outer annual recess respectively formed in the bottom surface of the cover board, wherein the inner annular recess, the outer annual recess and the cover board are concentric;

a joint seat having a center;

a top surface;

a positioning hole formed through the center of the joint seat;

two connecting blocks protruding separately and symmetrically from the top surface of the joint seat, respectively positioned in two corresponding sides of the positioning hole and protruding from the mounting hole of the cover board; and an annular sidewall mounted in the inner annular recess of the cover board; and a rotating disk having a center;

a top surface; and a column protruding from the center and the top surface of the rotating disk, protruding from the positioning hole of the joint seat, abutting the protrusion of the adapter and having an annular sidewall mounted in the outer annual recess of the cover board.

2. The mop as claimed in claim 1, wherein the handle has a top tube having a bottom end; and a bottom tube having a top end connected to the bottom end of the top tube.

3. The mop as claimed in claim 2, wherein the tubular connector further has an inside;

a middle section; and a positioning ring protruding from the inside and the middle section of the tubular connector and clamped between the top tube and the bottom tube.

4. The mop as claimed in claim 1, wherein the head assembly has a mounting board connected securely to the bottom surface of the cover board and having a bottom surface; and multiple fiber strips connected to the bottom surface of the mounting board.

5. The mop as claimed in claim 4, wherein each connecting block of the joint seat of the head assembly has a pivot hole formed in the connecting block and the pivot holes of the two connecting blocks align with each other; and the adapter has a bottom end; and a positioning tube mounted on the bottom end of the adapter aligning with the pivot holes of the joint seat of the head assembly, and two pins mounted respectively through the pivot holes and positioning tube to connect the handle and the head assembly pivotally.

6. The mop as claimed in claim 2, wherein the handle further has a slide tube mounted movably through the bottom tube and the bottom tube further has a bottom end; and the mop further has a fixing assembly mounted on the handle and having a threaded tube mounted around the bottom tube and the slide tube and connected securely to the bottom end of the bottom tube; and a nut mounted around the slide tube and screwed onto the threaded tube.

7. The mop as claimed in claim 6, wherein the slide tube has a top end;

the threaded tube further has an inside and an abutting surface formed around the inside of the threaded tube; and the fixing assembly further has a positioning sleeve mounted around the top end of the slide tube and having a bottom end surface abutting the abutting surface of the threaded tube.

8. The mop as claimed in claim 6, wherein the threaded tube further has a pressing surface; and the nut has a pushing surface abutting the pressing surface of the threaded tube.

* * * * *